United States Patent [19]

Ohba

[11] Patent Number: 5,053,796

[45] Date of Patent: Oct. 1, 1991

[54] LIGHT-SENSITIVE MATERIAL PROCESSING APPARATUS

[75] Inventor: Hisao Ohba, Kanagawa, Japan

[73] Assignee: Fuji Photo Film Co., Ltd., Kanagawa, Japan

[21] Appl. No.: 580,446

[22] Filed: Sep. 10, 1990

[30] Foreign Application Priority Data

Sep. 20, 1989 [JP] Japan ..... 1-243887

[51] Int. Cl.[5] ..... G03D 3/06; G03D 3/08

[52] U.S. Cl. ..... 354/322; 354/324; 354/325

[58] Field of Search ..... 354/298, 320, 321, 322, 354/324, 325

[56] References Cited

U.S. PATENT DOCUMENTS 4,310,616 1/1982 Hamada et al. .
4,796,042 1/1989 Mappin et al. ..... 354/324
4,882,246 11/1989 Ohba et al. .
4,969,002 11/1990 Nakayama ..... 354/325

FOREIGN PATENT DOCUMENTS 0114402 6/1984 European Pat. Off. .

*Primary Examiner*—A. A. Mathews

*Attorney, Agent, or Firm*—Sughrue, Mion, Zinn, Macpeak & Seas

[57] ABSTRACT

A light-sensitive material processing apparatus for processing an imagewise exposed light-sensitive material while the light-sensitive material is being conveyed to a plurality of processing tanks accommodating a processing solution. The apparatus includes a conductivity detector for detecting the electrical conductivity of the processing solution in a first processing tank; a first supplying device for replenishing a first replenisher to the first processing tank; a second supplying device for replenishing a second replenisher to at least a second processing tank; and a first controller which is adapted to supply the first replenisher to the first processing tank by actuating the first supplying device when the electrical conductivity of the processing solution in the first processing tank detected by the conductivity detector reaches a predetermined value, and is also adapted to supply the second replenisher to at least the second processing tank by actuating the second supplying device in an amount substantially proportional to the amount of the first replenisher supplied to the first processing tank. Accordingly, it is unnecessary to provide the second processing tank with the conductivity detector.

17 Claims, 2 Drawing Sheets

LIGHT-SENSITIVE MATERIAL PROCESSING APPARATUS

BACKGROUND OF THE INVENTION

1. Field of the Invention

The present invention relates to a light-sensitive material processing apparatus for processing an imagewise exposed light-sensitive material while the light-sensitive material is being conveyed to a plurality of processing tanks accommodating a processing solution.

2. Description of the Related Art

A light-sensitive material on which an image has been exposed, e.g., a presensitized printing plate for planographic process, is transported into a presensitized printing plate processor, which is a light-sensitive material processing apparatus, and is subjected to development in a developing tank provided in the presensitized printing plate processor, and is then washed in a rinsing tank or a washing tank before a finisher, i.e., a finishing solution, is applied thereto.

A developer in a processing tank for processing the light-sensitive material, such as the developing tank, undergoes variations in its concentration due to evaporation as well as deterioration due to processing. For this reason, the quantity of replenisher is set in accordance with the detected result of the electrical conductivity of the developer as well as the number of films processed so as to effect replenishment.

In other words, since the concentration of the developer becomes high owing to the evaporation of water contained in the developer, water is replenished in correspondence with the detected result of the electrical conductivity of the developer. In addition, both the concentrated developer and water are supplied in correspondence with the areas of the light-sensitive material processed so as to maintain the activity of the developer.

However, with the light-sensitive material processing apparatus having a plurality of processing tanks (e.g., a first developing tank, a second developing tank, and a finisher tank), it is necessary to provide a conductivity detector for each processing tank for development in order to detect the electrical conductivity of the processing solution in each processing tank. Hence, there have been problems in that this disadvantageously results in higher cost and that the maintenance operation for each of these conductivity detectors is troublesome.

In addition, it is conceivable to provide the conductivity detector only for the developing tank for which the variations in concentration are large among the plurality of developing tanks, and to replenish the aqueous solution only for that developing tank. Nevertheless, since the concentration of the developer in the other processing tanks becomes high, development residue produced from the light-sensitive material is not dissolved in the developer in the developing tanks and becomes solidified in the developing tanks. In addition, the concentration becomes high in the other processing tanks as well, resulting in faulty processing. Hence, there arises the problem that it is impossible to effect development on a stable basis over extended periods of time.

SUMMARY OF THE INVENTION

Accordingly, an object of the present invention is to provide a light-sensitive material processing apparatus which is capable of reducing the cost, of preventing the development residue from becoming solidified in a development tank, and of preventing a rise in the concentration of a processing solution, thereby overcoming the above-described drawbacks of the conventional art.

To this end, in accordance with the present invention, there is provided a light-sensitive material processing apparatus for processing an imagewise exposed light-sensitive material while the light-sensitive material is being conveyed to a plurality of processing tanks accommodating a processing solution. The apparatus includes a conductivity detector for detecting the electrical conductivity of the processing solution in a first processing tank; a first supplying device for replenishing a first replenisher to the first processing tank; a second supplying device for replenishing a second replenisher to at least a second processing tank; and a first controller which is adapted to supply the first replenisher to the first processing tank by actuating the first supplying device when the electrical conductivity of the processing solution in the first processing tank detected by the conductivity detector reaches a predetermined value, and is also adapted to supply the second replenisher to at least the second processing tank by actuating the second supplying device in an amount substantially proportional to the amount of the first replenisher supplied to the first processing tank.

In accordance with the light-sensitive material processing apparatus of the invention thus arranged, when the electrical conductivity of the processing solution in the first processing tank detected by the conductivity detector reaches a predetermined value, the first controller actuates the first supplying means so as to supply a replenisher with a concentration lower than that of the processing solution to the first processing tank. At the same time, the first controller actuates the second supplying device so as to supply the replenisher to at least the second processing tank in an amount proportional to the replenisher supplied to the first processing tank.

As a result, since the replenisher with a concentration lower than that of the processing solution is supplied to the first processing tank, it is possible to reduce variations in the concentration of the processing solution in the first processing tank. In addition, since the replenisher is supplied to at least the second processing tank in an amount proportional to the replenisher supplied to the first processing tank, the variations in the concentration of the processing solution are reduced for the processing tank to which the replenisher has been supplied. Furthermore, the processing solution is prevented from becoming solidified in the processing tank to which the replenisher has been supplied.

In addition, since the conductivity detector is not provided for the processing tanks other than the first processing tank, it is possible to reduce the cost as compared with cases where the conductivity detectors are provided for those other than the first processing tank. Furthermore, since it suffices to provide maintenance only for the conductivity detector disposed in the first processing tank, the maintenance operation can be facilitated.

In accordance with one mode of the invention, the first processing tank is constituted by a developing tank in which a developer for detecting the light-sensitive material is accommodated as the processing solution. This developing tank may be arranged to effect development by immersing the light-sensitive material therein, or may be arranged to effect development by applying the developer to the light-sensitive material.

In accordance with the one mode of the invention, the second processing tank is constituted by a developing tank for developing the light-sensitive material processed in the first processing tank, by using the developer serving as the processing solution. This developing tank may be arranged to effect development by immersing the light-sensitive material therein, or may be arranged to effect development by applying the developer to the light-sensitive material.

In accordance with another mode of the invention, the second processing tank is constituted by a finisher tank for processing the light-sensitive material processed with the processing solution in the first processing tank, by using a finisher serving as the processing solution. This finisher tank may be arranged to apply the finisher to the light-sensitive material conveyed thereto.

In accordance with one mode of the invention, water is used as the first replenisher and the second replenisher. As the water is replenished, the concentration of the processing solution (developer) is made low.

In accordance with the one aspect of the invention, the light-sensitive material processing apparatus further comprises a detecting device for detecting an area of the light-sensitive material being conveyed; a second controller for controlling the operation time of both concentrated processing solution supplying means for replenishing a concentrated processing solution to the second processing tank and a water supplying device for replenishing water thereto on the basis of a result of detection by the detecting device; and a processing solution supplying device for supplying the processing solution contained in the second processing tank from the second processing tank to the first processing tank.

In this mode, the area of the light-sensitive material being conveyed is detected by the detecting device. The operation time of both the concentrated processing solution supplying device and the water supplying device is calculated by the second controller on the basis of the result of detection by the detecting device. On the basis of the result of this calculation, the concentrated processing solution is replenished to the second processing tank by the concentrated processing solution supplying device and water is replenished thereto by the water supplying device. Also, the processing solution in the second processing tank is supplied from the second processing tank to the first processing tank by means of the processing solution supplying device.

Accordingly, both the concentrated developer and water are replenished in correspondence with the area of the light-sensitive material being conveyed, so that the activity of the developer is maintained irrespective of the area of the light-sensitive material processed.

Thus, in accordance with the present invention, since the replenishment to the second processing tank is effected by detecting the electrical conductivity of the processing solution in the first processing tank, it is possible to reduce the cost, and the development residue is prevented from becoming solidified. In addition, it is possible to prevent faulty processing due to an increase in the viscosity of the processing solution in a rinsing tank. Thus it is possible to obtain an outstanding advantage in that processing can be effected on a stable basis over extended periods of time.

The above and other objects, features and advantages of the present invention will become more apparent from the following detailed description of the invention when taken in conjunction with the accompanying drawings.

DESCRIPTION OF THE PREFERRED EMBODIMENT

Figure 1:
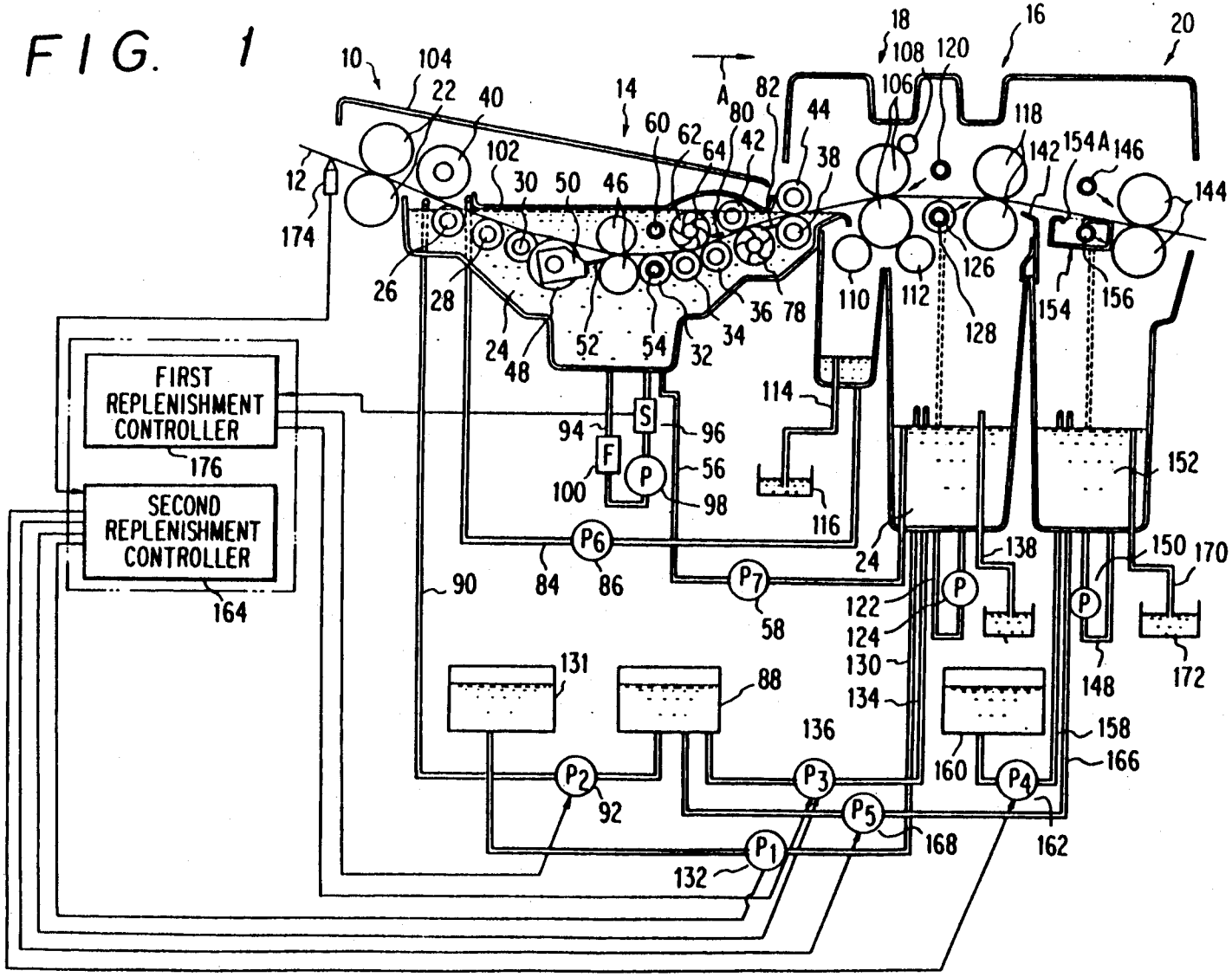
FIG. 1 is a schematic diagram illustrating an embodiment of a presensitized printing plate processor in accordance with the present invention.

FIG. 1 illustrates an embodiment of a presensitized printing plate processor 10 which is an example of a light-sensitive material processing apparatus in accordance with the present invention.

The presensitized printing plate processor 10 comprises a first developing tank 14 for developing a presensitized printing plate (hereafter referred to as PS plate) 12 with an image exposed by an unillustrated printer; a second developing tank 16 for auxiliarly developing the PS plate 12; an overflow tank 18 interposed between the first developing tank 14 and the second developing tank 16; and a finisher tank 20 for applying a finisher 152 to the PS plate 12.

First Developing Tank

As shown in FIG. 1, a pair of conveying rollers 22 are disposed adjacent to the first developing tank 14 for insertion of the PS plate 12. The PS plate 12 with an image exposed thereon by an unillustrated printer is inserted between the pair of conveying rollers 22, and the PS plate 12 inserted is conveyed into the presensitized printing plate processor 10 in a conveying direction (in the direction of arrow A in FIG. 1).

The upper side of the first developing tank 14 is open, and a central portion of its bottom projects downward, thereby forming a substantially dish-shaped configuration. A developer 24 is accommodated in the first developing tank 14. Guide rollers 26, 28, 30, 32, 34, 36 and 38 having the same diameter are disposed inside the first developing tank 14 along bottom wall portions thereof. These guide rollers 26–38 form split-type rollers in which a plurality of resilient roller members are pivotally supported on outer peripheries of their shafts, the shafts being supported by spanning an unillustrated pair of side plates.

A guide roller 40 having a larger diameter than that of the guide roller 26 is disposed above the guide roller 26, while a guide roller 42 is disposed above the guide roller 36. A guide roller 44 is disposed above the guide roller 38. These guide rollers 40, 42 and 44 are supported on the unillustrated pair of side plates in the same way as the guide rollers 26–38.

A pair of conveying rollers 46 are interposed between the guide roller 30 and the guide roller 32 in a central portion of the first developing tank 14. This pair of conveying rollers 46 are supported by the unillustrated pair of side plates, and rotate as a driving force of an unillustrated driving means is imparted thereto.

A guide roller 48 having a larger diameter than that of the guide roller 30 is interposed between the pair of conveying rollers 46 and the guide roller 30. This guide roller 48 is a split-type roller and is supported by the pair of side plates in the same way as the guide rollers 24–38. A guide 52 is supported to the guide roller 48 via a bracket 50. The guide 52 has one end fixed to the bracket 50 and the other end oriented toward the pair of conveying rollers 46. Thus the PS plate 12 is guided to between the pair of conveying rollers 46.

Accordingly, the PS plate 12 fed to the first developing tank 14 by the pair of conveying rollers 22 is inserted between the guide roller 26 and the guide roller 40, is then guided by the guide rollers 28, 30 and 48 and falls diagonally downward, and then inserted between the pair of conveying rollers 46 by the guide 52. After passing through the pair of conveying rollers 46, the PS plate 12 is guided by the guide rollers 32, 34, 36, 42 and 38 and rises diagonally upward, and is then fed to the overflow tank 18 while being guided by the guide roller 44. Thus the PS plate 12 is immersed in the developer 24 in the first developing tank 14 nd is subjected to development.

The guide roller 32 is formed in such a manner that a plurality of resilient rotating members are pivotally supported on an outer periphery of a spray pipe 54 with a plurality of discharge ports formed along the axial direction thereof. This spray pipe 54 communicates with one end of a pipeline 56. The other end of the pipeline 56 is passed through a bottom of the second developing tank 16 and is open inside the second developing tank 16. Disposed midway in the pipeline 56 is a supply pump 58 ($P_7$) whereby the developer 24 inside the second developing tank 16 is supplied through the spray pipe 54 so as to be supplied to the interior of the first developing tank 14.

A spray pipe 60 is disposed above the guide roller 32. The spray pipe 60 has a plurality of discharge ports which are arranged along the axial direction thereof and are open toward the pair of conveying rollers 46. This spray pipe 60 also communicates with the pipeline 56, and the developer 24 in the second developing tank 16 is supplied thereto by the supply pump 58 so as to be supplied to the interior of the first developing tank 14.

A brush 62 is interposed between the spray pipe 60 and the guide roller 42. The brush 62 has a rotating shaft 64 rotatably supported by the unillustrated pair of side plates and rotates as a driving force of an unillustrated driving means is imparted thereto.

The brush 62 has an unillustrated elongated carpet brush spirally wound around the adhered to the rotating shaft 64 via a nylon sheet (not shown). The bristles of the carpet brush are formed of nylon, ETEF, PPS, PP, or the like. The outside diameter of the brush 62 is 40 mm or less, preferably 20–40 mm, while the diameter of the bristle is set to 20–70 μ. The number of revolutions of the brush 62 is set to 300 r.p.m. or less, preferably 60–200 r.p.m.

In addition, the brush 62 may be formed by providing its rotating shaft 64 with a spiral groove and by inserting an unillustrated twisted brush into the groove and winding the same around the shaft 64. In this case, the twisted rush is formed by twisting two wires having bristles therebetween to fix them. If the wires of the twisted brush are inserted into the groove, the bristles project substantially uniformly to the outside the groove in a spreading manner, and the radially projecting bristles are thus disposed substantially uniformly around the rotating shaft. The twisted brush is formed of the same material as that of the aforementioned carpet brush.

As shown in FIG. 1, a brush 78 having the same construction as that of the brush 62 is deposed underneath a conveying passage of the PS plate 12 between the guide roller 36 and the guide roller 38.

A spring-up preventing plate 80 is deposed on the guide roller 42 side of the brush 62. The spring-up preventing plate 80 serves to prevent the up and down movements of a rear-end portion of the PS plate 12 which has passed between the brush 62 and the guide roller 36. Furthermore, another spring-up preventing plate 82 is disposed between the brush 78 and the guide roller 38. The spring-up preventing plate 82 serves to prevent the up and down movements of the rear-end portion of the PS plate 12 in the same way as the spring-up preventing plate 80.

A pipeline 84 communicating with a bottom of the overflow tank 18 is open above the first developing tank 14. A supply pump 86 ($P_6$) is deposed midway in the pipeline 84. In addition, a pipeline 90 communicating with a water supply tank 88 is open above the first developing tank 14, and a water supply pump 92 ($P_2$) is deposed midway in the pipeline 90. This water supply pump 92 is connected to a first replenishment controller 176 which will be described later. The first replenishment controller 176 controls the timing at which water is supplied to the first developing tank 14.

The water supply pump 92 is operated to supply water to the first developing tank 14 when the electrical conductivity of the developer 24 in the first developing tank 14 reaches a predetermined value as the result of detection by a conductivity detector 96 (S).

One end of a pipeline 94 communicates with a lower portion of the first developing tank 14. The conductivity detector 96 (S), a circulation pump 98, and a filter 100 (F) are disposed midway in the pipeline 94, and the other end of the pipeline 94 communicates with the spray pipes 60, 54. Accordingly, after the developer 24 sorted in the lower portion of the first developing tank 14 passes through the pipeline 94 and through the conductivity detector 96 and the filer 100, the developer 24 is sent again to the spray pipes 54, 60 inside the first developing tank 14. As a result, the electrical conductivity of the developer 24 is detected, the dust in the developer 24 is removed, and the developer 24 inside the first developing tank 14 is stirred.

The conductivity detector 96 also detects the electrical conductivity of the developer 24 passing through the pipeline 94 by means of the first replenishment controller 176 so as to detect the electrical conductivity of the developer 24 in the first developing tank 14, and transmits the detected result of the first replenishment controller 176.

A developer levelcover 102 is disposed so as to cover the surface portion of the fist developing tank 14. The movement of the developer level cover 102 in the direction of conveyance of the PS plate 12 is restricted by an unillustrated stopper, but its movement in the heightwise direction of the developer level is not restricted. Accordingly, when the amount of the developer 24 in the first developing tank 14 becomes small and the level of the developer 24 is thereby lowered, the developer level cover 102 also moves downward correspondingly. As a result, the developer level cover 102 prevents the deterioration of the developer 24 which can occur as the developer 24 is brought into contact with carbon dioxide contained in the air. In addition, the developer level cover 102 also prevents the evaporation of the developer 24.

A guide cover 104 for re-entry is disposed in an upper portion of the first developing tank 14. The guide cover 104 guides the insertion of the PS plate 12 which has been processed once into the second developing tank 16 by jumping the first developing tank 14 so as to effect both development and finisher processing again.

Overflow Tank

An upper portion of the side wall of the first developing tank 14 located on the overflow tank 18 side is folded toward the overflow tank 18, and the developer 24 in the first developing tank 14 overflows from this upper portion of the side wall so as to be recovered in the overflow tank 18.

A pair of conveying rollers 106 are disposed above the side walls serving as a partition between the overflow tank 18 and the second developing tank 16. The pair of conveying rollers 106 are rotatably supported by the unillustrated side plates, and rotate as a driving force of the unillustrated driving means is imparted thereto. The PS plate 12 fed out from between the guide rollers 38 and 44 is inserted between the pair of conveying rollers 106.

A small-diameter roller 108 is disposed in contact with the upper one of the pair of conveying rollers 106. The roller 108 prevents the developer 24 in the second developing tank 16 attached to the upper one of the pair of conveying rollers 106 from dropping into the overflow tank 18.

A roller 110 disposed in the overflow tank 18 and a roller 112 disposed in the second developing tank 16 abut against the lower one of the pair of conveying rollers 106. The roller 110 prevents the developer 24 fetched by the PS plate 12 in the first developing tank 14 and adhered to the lower one of the conveying rollers 106 from dropping into the second developing tank 16. Meanwhile, the roller 112 prevents the developer 24 in the second developing tank 16 from dropping into the overflow tank 18.

A pipeline 114 passing through the bottom of the overflow tank 18 has one end extending from that bottom up to a predetermined height, and the height of the level of the developer 24 in the overflow tank 18 is set by the height of this pipeline 114 from the bottom of the overflow tank 18. The other end of the pipeline 114 is open in a drain tank 116.

Second Developing Tank

A pair of conveying rollers 118 are disposed in an upper portion of the second developing tank 16 adjacent to the finisher tank 20. The pair of conveying rollers 118 are rotatably supported by the unillustrated side plates, and rotate as a driving force of the unillustrated driving means is imparted thereto. The PS plate 12 fed out from between the pair of conveying rollers 106 is inserted between the pair of conveying rollers 118. As a result, the PS plate 12 is conveyed in an upper portion of the second developing tank 16 substantially horizontally.

a spray pipe 120 having the same construction as that of the aforementioned spray pipe 54 is disposed above the conveying passage of the PS plate 12 between the upper one of the pair of conveying rollers 106 and the upper one of the pair of conveying rollers 118. Discharge ports of the spray pipe 120 for discharging the developer 24 are open toward the upper one of he pair of conveying rollers 106, and discharge and supplied developer 24 to between the upper one of the pair of conveying rollers 106 and the upper surface of the PS plate 12. The spray pipe 120 communicates with one end of a pipeline 122. The other end of the pipeline 122 communicates with the bottom of the second developing tank 16, a circulation pump 124 being disposed midway thereof. The developer 24 is stored in the lower portion of the second developing tank 16, and the developer 24 is supplied through the spray pipe 120 by the operation of the circulation pump 124. Thus the developer 24 is discharged and applied to the surface of the PS plate 12.

A guide roller 126 is disposed underneath the conveying passage of the PS plate 12 in correspondence with the spray pipe 120. The guide roller 126 is formed in such a manner that a plurality of resilient rotating members are pivotally supported on an outer periphery of a spray pipe 128 with a plurality of discharge ports formed along the axial direction thereof, in the same way as the guide roller 32. This spray pipe 128 communicates with the pipeline 122, and the developer 24 is supplied thereto by the operation of the circulation pump 124.

The spray pipe 128 has the plurality of discharge ports facing the space between the lower one of the pair of conveying rollers 118 and the reverse surface of the PS plate 12. Thus the developer 24 supplied is discharged and applied to the reverse surface of the PS plate 12.

One end of a pipeline 130 communicates with the bottom of the second developing tank 16. The other end of the pipeline 130 communicates with a concentrated developer stock tank 131. A replenishing developer supply pump 132 ($P_1$) is disposed midway in the pipeline 130. The replenishing developer supply pump 132 is connected to a second replenishment controller 164 which will be described later, and its operation is thereby controlled.

In addition, one end of a pipeline 134 communicates with the bottom of the second developing tank 16. The other end of the pipeline 134 communicates with the water supply tank 88. A water supply pump 136 ($P_3$) is deposed midway in the pipeline 134. This water supply pump 136 is connected to the first replenishment controller 176 as well as the second replenishment controller 164, and its operation is thereby controlled.

Also, one end of a pipeline 138 is passed through the bottom of the second developing tank 16 and projects into the second developing tank 16. The other end of the pipeline 138 is open in a drain tank 140, and the developer 24 overflowing through the pipeline 138 is discharged to the drain tank 140.

Finisher Tank

A partition plate 142 is disposed erected on the side walls partitioning the second developing tank 16 and the finisher tank 20. This partition plate 142 prevents the developer 24 attached to the pair of conveying rollers 118 from mixing into the finisher 152 inside the finisher tank 20.

A pair of conveying rollers 144 are disposed in an upper portion of the finisher tank 20 adjacent to the exit side thereof. The pair of conveying rollers 144 are rotatably supported by the unillustrated side plates, and rotate as a driving force of the unillustrated driving means is imparted thereto. The pair of conveying rollers 144 are arranged at a slightly lower position than the pair of conveying rollers 118. The PS plate 12 fed out from between the pair of conveying rollers 118 is inserted between the pair of conveying rollers 144. Thus the PS plate 12 is conveyed through the upper portion of the second developing tank 16 diagonally downward.

A spray pipe 146 having the same construction as that of the aforementioned spray pipe 60 is disposed above the conveying passage of the PS plate 12 between the pair of conveying rollers 118 and the pair of conveying rollers 144. The discharge ports of the spray pipe 146 for discharging the finisher 152 are open to and the upper one of the pair of conveying rollers 144, and discharge the supplied finisher 152 to between the upper one of the pair of conveying rollers 144 and the upper surface of the PS plate 12. This spray pipe 146 communicates with one end of the pipeline 148. The other end of he pipeline 148 communicates with a bottom of the finisher tank 20, a circulation pump 150 being deposed midway thereof. The finisher 152 is stored in a lower portion of the finisher tank 20, and the finisher 152 is supplied through the spray pipe 146 by the operation of the circulation pump 150. Thus the finisher 152 is discharged ad applied to the upper surface of the PS plate 12.

A finisher applying box 154 is disposed underneath the conveying passage of the PS plate 12 in correspondence with the spray pipe 146. The finisher applying box 154 has a substantially U-shaped cross section, an opening 154A being formed at an upper portion thereof. A spray pipe 156 is disposed in the finisher applying box 154. This spray pipe 156 has a plurality of discharge ports formed along the axial direction thereof in the same way as the spray pipe 146 such as to be oriented toward an angular portion of the finisher applying box 154. The spray pipe 156 communicates with a pipeline 148, and the finisher 152 is supplied through the finisher applying box 154 by the operation of the circulation pump 150. The finisher 152 supplied to the finisher applying box 154 overflow from the opening 154A and is applied to the reverse surface of the PS plate 12 passing over it.

One end of a pipeline 158 communicates with the bottom of the finisher tank 20. The other end of the pipeline 158 communicates with a concentrated finisher stock tank 160. A replenishing finisher supply pump 162 ($P_4$) is disposed midway in the pipeline 158. The replenishing finisher supply pump 162 is connected to the second replenishment controller 164, and its operation is thereby controlled.

Also, one end of a pipeline 166 communicates with the bottom of the finisher tank 20. The other end of the pipeline 166 communicates with the water supply tank 88. A water supply pump 168 ($P_5$) is disposed midway in the pipeline 166. This water supply pump 168 is connected to the first replenishment controller 176 and the second replenishment controller 164, and its operation is thereby controlled.

In addition, one end of a pipeline 170 is passed through the bottom of the finisher tank 20 and projects into the finisher tank 20. The projecting height of the pipeline 170 into the finisher tank 20 sets the height of the level of the finisher 152. The other end of the pipeline 170 is open in a drain tank 172, and discharges the finisher 152 overflowing through the pipeline 170.

A detector 174 connected to the second replenishment controller 164 is disposed on the insertion side of the pair of conveying rollers 22. The detector 174 detects the time duration of passage of the PS plate 12 at the insertion port of the presensitized printing plate processor 10, and the second replenishment controller 164 calculates the area of the PS plate 12 inserted into the presensitized printing plate processor 10 by incorporating into the calculation a processing speed for the PS plate 12 and a width of the PS plate that are preset.

In addition, the first replenishment controller 176 operates the water supply pumps 92, 136 and 168 on the basis of the result of detection by the conductivity detector 96 so as to replenish water for the first developing tank 14, the second replenishing tank 16, and the finisher tank 20.

A description will now be given of the operation of this embodiment.

The PS plate 12 with an image exposed thereon by an unillustrated printer is inserted between the pair of conveying rollers 22 and between the guide roller 40 and the guide roller 26 in the first developing tank 14, and is inserted into the first developing tank 14. The PS plate 12 is lowered while being guided by the guide rollers 28, 30 and 48 and is fed to the central portion of the first developing tank 14.

The large-diameter guide roller 48 guides the tip of the PS plate 12 without causing it to deviate from a predetermined conveying passage, while the guide 52 functions to insert the tip of the PS plate between the pair of conveying rollers 46.

The PS plate 12 inserted between the pair of conveying rollers 46 and fed out therefrom rises while being guided by the guide rollers 32, 34, 36, 42, 38 and 44, and is fed out from the first developing tank 14.

The PS plate 12, when nipped and conveyed by the pair of conveying rollers 46, is squeezed in the developer 24 in the first developing tank 14, and the developer 24 is sprayed onto it by means of the spray pipes 54 and 60 immediately after that. In addition, the developer 24 in the first developing tank is circulated by means of the spray pipes 54 and 60.

Furthermore, the both surfaces of the PS plate 12 are scraped by the brushes 62 and 78 so as to scrape off unnecessary portions of the light-sensitive layer which have swollen or have been dissolved. Thus the PS plate 12 is developed substantially completely.

Since the brushers 62 and 78 are formed with small diameters, the rotating shaft 64 is disposed in the developer 24. Hence, the amount of contact of the developer 24 with the air is reduced, with the result that the deterioration of the developer 24 is prevented and the first developing tank 14 can be made compact, thereby reducing the cost.

In addition, the developer 24 overflowing from the first developing tank 14 and discharged into the overflow tank 18 is discharged to the drain tank 116 through the pipeline 114.

The developing tank 24 discharged to the overflow tank 18 by overflowing from the first developing tank 14 passes through the pipeline 84 by means of the pump 86 and is supplied again to the first developing tank 14, so that the developer 24 can be utilized effectively.

As the PS plate 12 fed out from the first developing tank 14 is being nipped and conveyed by the pair of conveying rollers 106, the developer 24 is squeezed off the PS plate 12, and the PS plate 12 is fed out to between the pair of conveying rollers 118. The PS plate 12 thus fed out is then conveyed substantially horizontally while being guided by the guide roller 126 through the upper portion of the second developing tank 16.

In the course of this conveyance, the developer 24 is discharged and applied to the both surfaces of the PS plate 12 by means of the spray pipes 120, 128. As a result, the PS plate 12 is developed.

Although the developer 24 in the first developing tank 14 is fatigued owing to the development of the PS plate 12, the concentrated developer and water are replenished into the second developing tank 16 by the second replenishment controller 164, and the developer 24 is replenished into the first developing tank 14 from the second developing tank 16, thereby recovering the fatigue. The developer 24 is discharged from the overflow tank 18 to the drain tank 116 via the pipeline 114.

Since the PS plate to which the developer 24 is applied in the second developing tank 16 has already been subjected to development in the first developing tank 14, the amount of deterioration of the developer 24 due to processing in the second developing tank 16 is small. Accordingly, the developer 24 in the second developing tank 16 with a very small degree of deterioration is supplied to the first developing tank 14. In addition, since the surface of the developer 24 in the first developing tank 14 is covered with the developer level cover 102, the deterioration of the developer 24 due to contact with the air is prevented, and the amount of evaporation of the developer 24 can be reduced. In consequence, the developer 24 can be used over extended periods of time, so that it is possible to process the PS plate 12 over extended periods of time on a stable basis.

Next, a description will be given of the replenishment of the developer 24.

In cases where a multiplicity of PS plates 12 are developed in the first developing tank 14, the developer 24 becomes fatigued. In order to effect recovery from the deterioration of the developer 24, the area of the PS plate 12 to be processed is detected by the detector 174, and a calculation is conducted by the second replenishment controller 164 so as to replenish a required amount of the developer 24.

Specifically, the arrangement provided is such that the area of the PS plate 12 to be inserted is detected by the detector 174, the operating times of the replenishing developer supply pump 132 and the water supply pump 136 are calculated by the second replenishment controller 164 on the basis of the detected result, and the replenishing developer supply pump 132 and the water supply pump 136 are operated so as to supply the replenishing developer by an amount corresponding to the area of the PS plate 12. Then, the supply pump 58 (P7) is operated for a fixed time so that the developer 24, which is substantially close to a new solution, is supplied to the first developing tank 14 by an amount equivalent to the amount replenished to the second developing tank 16.

The electrical conductivity of the developer 24 in the first developing tank 14 is detected by the conductivity detector 96, and if the developer 24 becomes condensed and its electrical conductivity increases above a predetermined value, the water supply pump 92 is operated by the first replenishment controller 176 so as to supply water into the first developing tank 14. In addition, with respect to the second developing tank 16 and the finisher tank 20 as well, the amount of water to evaporate is measured in advance, and the water supply pumps 136, 168 are operated in proportion to the operation of the water supply pump 92.

In this case, an arrangement may be provided such that the water supply pumps 136, 168 are operated in correspondence with the electrical conductivity detected by the conductivity detector 96 so as to replenish the amount of water evaporated in the finisher tank 20.

The replenisher of the finisher and water are replenished to the finisher tank 20 by the replenishing finisher supply pump 162 and the water supply pump at fixed rates by being controlled by the second replenishment controller 164.

As a result, the condensation of the developer 24 and the finisher 152 is prevented, and as the activity of the developer 24 and the finisher 152 are maintained at constant levels, so that stable development over extended periods of time is possible.

Figure 2:
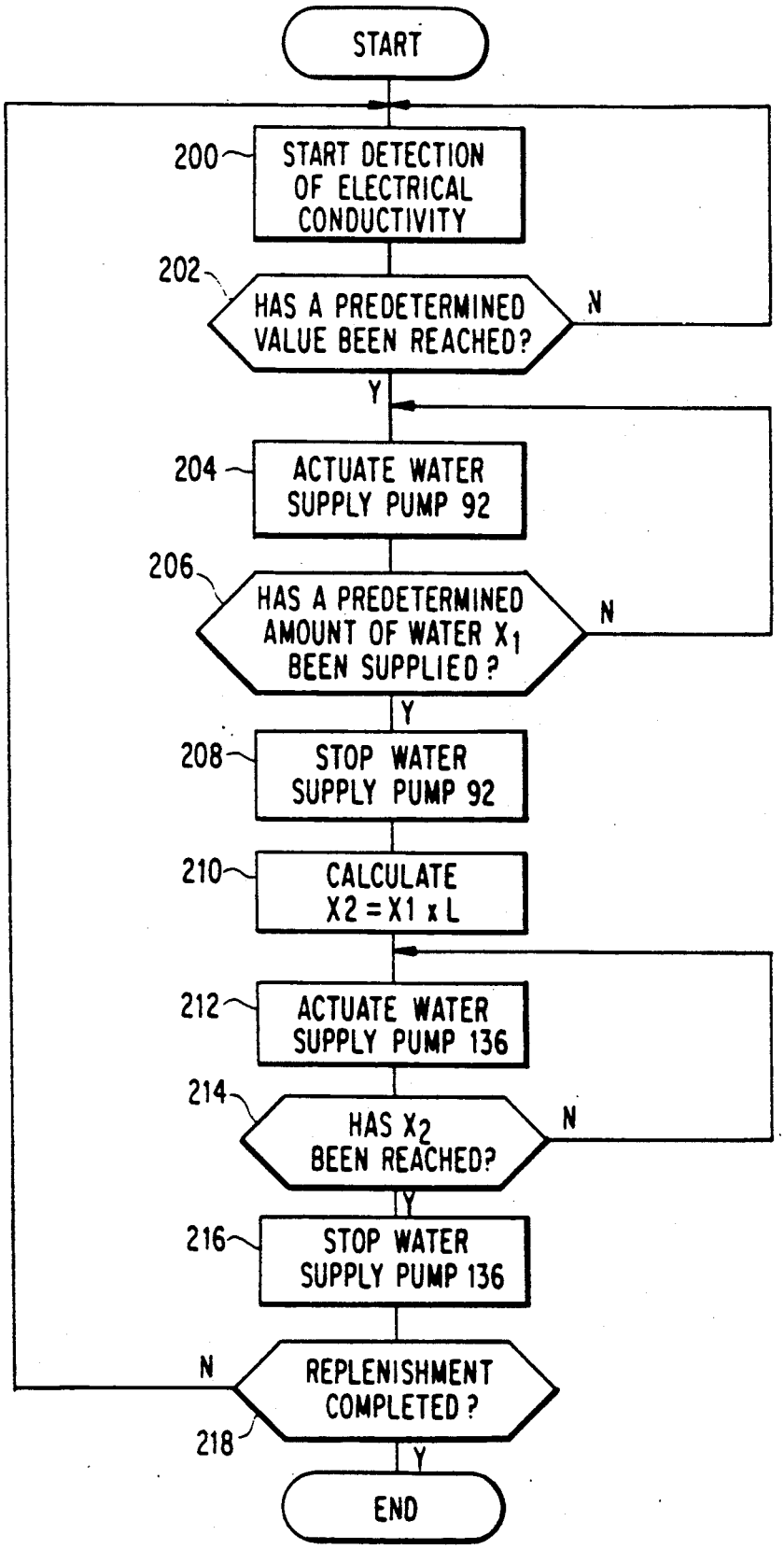
FIG. 2 is a flowchart illustrating the operation of a first replenishment controller.

Referring now to the flowchart shown in FIG. 2, a description will now be given of the operation of the first replenishment controller 176 for supplying water to the first and second developing tanks 14, 16 by operating the water supplying pumps 92 and 136.

In Step 200, the conductivity detector 96 detects the electrical conductivity of the developer 24 in the first developing tank 14. At this stage, since the water in the developer 24 in the first developing tank 14 has evaporated slightly, the developer 24 is condensed by the evaporated portion, so that the electrical conductivity of the developer 24 increases. As the increased electrical conductivity is detected in Step 200, the amount of water evaporating in the developer 24 in the first developing tank 14 is measured. In Step 202, a determination is made as to whether or not the electrical conductivity detected has reached a predetermined value. If the electrical conductivity detected has not reached the predetermined value, the operation returns to Step 200 so as to repeat the detection of the electrical conductivity by means of the conductivity detector 96.

If it is determined in Step 202 that the electrical conductivity detected has reached the predetermined value, the operation proceeds to Step 204 where the water supply pump 92 is operated to supply water to the first developing tank 14. The amount of this water $X_1$ supplied is set to 10 cc/cycle to 1,000 cc/cycle, and water is preferably supplied at a rate of 20 cc/cycle to 200 cc/cycle.

After undergoing this water-supplying process, the developer 2, which became condensed owing to the evaporation of water with a resultant rise in electrical conductivity, is diluted. The electrical conductivity of the developer 24 keeps on declining due to dilution, but variations in the conductivity continue to be detected by the conductivity detector 96. Until the electrical conductivity reaches the predetermined value through dilution, a determination is made in Step 206 as to whether or not a required amount of water has been supplied to the first developing tank 14. That is, in Step 206, a determination is made as to whether water still needs to be supplied in order to allow the electrical conductivity to reach the predetermined value. In cases where the electrical conductivity after dilution has not reached the predetermined value, the water supply pump 92 is operated in Step 204 to continue the supply of water.

When the water supply pump 92 is operated and water is supplied until the electrical conductivity after dilution reaches the predetermined value, the operation of the water supply pump 92 is stopped in Step 208, thereby stopping the supply of water to the first developing tank 14.

In Step 210, the amount of water $X_2$ supplied to the second developing tank 16 is calculated. This calculation is expressed by a value in which a ratio L between the amount of evaporation of water in the developer 24 in the first developing tank 14 and the amount of evaporation of water in the developer 24 in the second developing tank 16 is multiplied by the amount of water $X_1$ supplied to the first developing tank 14, i.e., by the following formula:

$$X_2 \propto X_1 \times \frac{\text{(amount of evaporation in the second developing tank)}}{\text{(amount of evaporation in the first developing tank)}}$$

According to this formula, the amount of water supplied to the second developing tank 16 is proportional to the amount of water supplied to the first developing tank 14.

When the amount of water supplied to the second developing tank 16 is calculated on the basis of the above formula, the water supply pump 136 is operated in Step 212 to start the supply of water to the second developing tank. In Step 214, a determination is made as to whether or not the amount of water supplied to the second developing tank has reached $X_2$. If the amount of water supplied has not reached $X_2$, the supply of water is continued, and if it has reached $X_2$, the operation of the water supply pump 136 is stopped.

Accordingly, since water is supplied to the second developing tank 16, the concentration of the developer 24 in the second developing tank 16 does not become high. Consequently, the amount of development residue produced from the surface of the PS plate 12 is reduced, thereby making it possible to effect development on a stable basis over extended periods of time.

In Step 218, a determination is made as to whether or not the supply of water is to be continued, and if the supply is to be effected again, the procedures stated in Step 200 and thereafter are repeated. Meanwhile, if the supply of water is not be to continued, the operation ends.

As described above, in this embodiment since water is supplied to the second developing tank 16 in an amount proportional to the amount of water supplied to the first developing tank 14, the amount of development residue produced can be reduced without an increase in the concentration of the developer 24 in the second developing tank 16.

It should be noted that although in the foregoing embodiment an example of the presensitized printing plate 12 has been given as a light-sensitive material, the present invention is not restricted to the same, and the present invention can be applied to a developing apparatus for a light-sensitive recording material, such as a developing apparatus for a planographic printing plate using no water, as another example of the light-sensitive material.

Although in the embodiment an example has been given of the case where the invention is applied to the first and second developing tanks 14, 16, the invention is not restricted to the same and may be applied to the finisher tank 20.

Furthermore, although in the embodiment a description has been given of a type of the first developing tank 14 in which the light-sensitive material is immersed for development and of a type of the second developing tank 16 in which the developer is applied to the light-sensitive material, the present invention is applicable to a light-sensitive material processing apparatus in which the developing tanks are of any type.

What is claimed is:

1. A light-sensitive material processing apparatus for processing an im[illegible]wise exposed light-sensitive material while the light-sensitive material is being conveyed to a plurality of processing tanks accommodating a processing solution, said apparatus comprising:

a conductivity detector for detecting the electrical conductivity of the processing solution in a first processing tank;

first supplying means for replenishing a first replenisher to said first processing tank;

second supplying means for replenishing a second replenisher to at least a second processing tank; and first controlling means which is adapted to supply the first replenisher to said first processing tank by actuating said first supplying means when the electrical conductivity of the processing solution in said first processing tank detected by said conductivity detector reaches a predetermined value, and is also adapted to supply the second replenisher to at least said second processing tank by actuating said second supplying means in an amount substantially proportional to the amount of the first replenisher supplied to said first processing tank.

2. A light-sensitive material processing apparatus according to claim 1, wherein said first processing tank comprises a developing tank in which a developer for developing the light-sensitive material is accommodated as the processing solution.

3. A light-sensitive material processing apparatus according to claim 1, wherein said second processing tank comprises a developing tank for developing the light-sensitive material processed in said first processing tank, by using the developer serving as the processing solution.

4. A light-sensitive material processing apparatus according to claim 1, wherein said second processing tank comprises a finisher tank for processing the light-sensitive material processed with the processing solution in said first processing tank, by using a finisher serving as the processing solution.

5. A light-sensitive material processing apparatus according to claim 1, wherein water is used as the first replenisher and the second replenisher.

6. A light-sensitive material processing apparatus according to claim 1, further comprising:

detecting means for detecting an area of the light-sensitive material being conveyed;

second controlling means for controlling the operation time of both concentrated processing solution supplying means for replenishing a concentrated processing solution to said second processing tank and water supplying means for replenishing water thereto on the basis of a result of detection by said detecting means; and processing solution supplying means for supplying the processing solution contained in said second processing tank from said second processing tank to said first processing tank.

7. A light-sensitive material processing apparatus according to claim 6, wherein said processing solution supplying means is adapted to supply the processing solution contained in said second processing tank to said first processing tank in an amount substantially equivalent to a total amount of the concentrated processing solution and the water replenished to said second processing tank by said concentrated processing solution supplying means and said water supplying means, respectively.

8. A light-sensitive material processing apparatus for processing an imagewise exposed light-sensitive material while the light-sensitive material is being conveyed consecutively to a plurality of processing tanks accommodating a processing solution, said apparatus comprising:

a conductivity detector for detecting the electrical conductivity of the processing solution in a first processing tank disposed on an uppermost stream side in an advancing direction of the light-sensitive material;

first supplying means for replenishing a first replenisher to said first processing tank;

second supplying means for replenishing a second replenisher to at least a second processing tank disposed downstream of said first processing tank in the advancing direction of the light-sensitive material; and first controlling means which is adapted to supply the first replenisher to said first processing tank by actuating said first supplying means when the electrical conductivity of the processing solution in said first processing tank detected by said conductivity detector reaches a predetermined value, and is also adapted to supply the second replenisher to said second processing tank by actuating said second supplying means in an amount substantially proportional to the amount of the first replenisher supplied to said first processing tank.

9. A light-sensitive material processing apparatus according to claim 8, wherein said second processing tank is disposed adjacent to said first processing tank.

10. A light-sensitive material processing apparatus according to claim 8, wherein at least one other processing tank is interposed between said first processing tank and said second processing tank.

11. A light-sensitive material processing apparatus according to claim 8, wherein said first processing tank comprises a first developing tank in which a developer for developing the light-sensitive material with the light-sensitive material immersed therein is accommodated as the processing solution.

12. A light-sensitive material processing apparatus according to claim 8, wherein said second processing tank comprises a developing tank for developing the light-sensitive material processed in said first processing tank, by using the developer serving as the processing solution.

13. A light-sensitive material processing apparatus according to claim 8, wherein said second processing tank comprises a finisher tank for processing the light-sensitive material processed with the processing solution in said first processing tank, by using a finisher serving as the processing solution.

14. A light-sensitive material processing apparatus according to claim 8, wherein water is used as the first replenisher and the second replenisher.

15. A light-sensitive material processing apparatus according to claim 8, further comprising:

detecting means for detecting an area of the light-sensitive material being conveyed;

second controlling means for controlling the operation time of both concentrated processing solution supplying means for replenishing a concentrated processing solution to said second processing tank and water supplying means for replenishing water thereto on the basis of a result of detection by said detecting means; and processing solution supplying means for supplying the processing solution contained in said second processing tank from said second processing tank to said first processing tank.

16. A light-sensitive material processing apparatus according to claim 15, wherein said processing solution supplying means is adapted to supply the processing solution contained in said second processing tank to said first processing tank in an amount substantially equivalent to a total amount of the concentrated processing solution and the water replenished to said second processing tank by said concentrated processing solution supplying means and said water supplying means, respectively.

17. A light-sensitive material processing apparatus according to claim 16, wherein said concentrated processing solution is constituted by a concentrated developer.

* * * * *